United States Patent [19]

Barrett et al.

[11] Patent Number: 4,722,758

[45] Date of Patent: Feb. 2, 1988

[54] METHOD OF COVERING AN ELECTRICAL CONNECTION OR CABLE WITH A FLUOROELASTOMER MIXTURE

[75] Inventors: Len Barrett, San Jose; Neville Batliwalla, Foster City; James Rinde, Fremont; Norman A. Gac, Palo Alto, all of Calif.

[73] Assignee: Raychem Corporation, Menlo Park, Calif.

[21] Appl. No.: 772,287

[22] Filed: Sep. 4, 1985

[51] Int. Cl.[4] ..... H01B 13/08

[52] U.S. Cl. ..... 156/53; 156/56; 156/86; 174/110 FC; 174/DIG. 8

[58] Field of Search ..... 156/53, 56, 86; 174/110 FC, DIG. 8; 428/379, 421, 422

[56] References Cited

U.S. PATENT DOCUMENTS

| | | | |
|---|---|---|---|
| 4,421,878 | 12/1983 | Close | 428/422 X |
| 4,634,615 | 1/1987 | Versteegh et al. | 156/86 X |
| 4,666,642 | 5/1987 | Glaister | 428/422 X |

*Primary Examiner*—Robert A. Dawson

*Attorney, Agent, or Firm*—Timothy H. P. Richardson; Herbert G. Burkard

[57] ABSTRACT

Curable compositions which are useful for encapsulating electrical connections and for joining metals to metals, and which comprise a mixture of high and low molecular weight fluorocarbon elastomers. Preferred compositions comprise a mixture of three fluorocarbon elastomers, the first having a Mooney viscosity at 121° C. of at least 120, the second a Mooney viscosity at 121° C. of 80 to 110, and the third a Brookfield viscosity at 100° C. of 1,000 to 4,000 centipoises, in amounts 5 to 50%, 25 to 70% and 5 to 50% respectively, based on the weight of the polymeric component. The compositions can be easily molded under heat and pressure, and after they have been cured, they have remarkable resistance to degradation by hot liquids, even under pressure. Consequently, the compositions are very useful in the manufacture of self-regulating heaters for use in heating the production tubes of oil wells.

16 Claims, No Drawings

METHOD OF COVERING AN ELECTRICAL CONNECTION OR CABLE WITH A FLUOROELASTOMER MIXTURE

BACKGROUND OF THE INVENTION

1. Field of the Invention

This invention relates to curable compositions which are useful for encapsulating electrical connections and for joining metals to metals.

2. Background of the Invention

It is known to use curable polymeric compositions as adhesive and encapsulating compositions. However, there remains a need for improved compositions which are easier to prepare or to apply, or which have improved properties after application.

SUMMARY OF THE INVENTION

This invention relates to novel compositions which are useful as adhesives and/or as encapsulants, and which comprise a polymeric component comprising (i) at least 50% by weight, based on the weight of the polymeric component, of at least one relatively high molecular weight fluorocarbon elastomer having a Mooney viscosity at 121° C. of at least 75, and (ii) 5 to 50% by weight, based on the weight of the polymeric component, of at least one relatively low molecular weight fluorocarbon elastomer having a Brookfield viscosity at 100° C. of 1,000 to 5,000 centipoises;

The compositions, prior to curing, are solid at room temperature, but are heated during use to soften them so that they can be brought into intimate contact with the substrate(s) to be encapsulated and/or joined together; they are then cured to give the desired final properties. The cured compositions show remarkable resistance to degradation by hot liquids, including hot mixtures of aqueous acids and hydrocarbons such as are found in oil wells. The latter property makes them particularly useful in the construction of electrical heaters for use in such environments, in particular self-limiting heaters for heating the production tubes of oil wells.

DETAILED DESCRIPTION OF THE INVENTION

The novel compositions can, and usually do, contain other ingredients in addition to the fluorocarbon elastomers. Typically, such other ingredients include acid scavengers such as lead oxide or magnesium oxide, e.g. in amount 3 to 8% by weight, and reinforcing agents such as reinforcing carbon black and barium sulfate, e.g. in amount 8 to 25% by weight. Carbon black is usually preferred as the reinforcing agent because of its advantageous effect on physical properties, but under some circumstances, when particularly good electrical properties are needed, barium sulfate may be used in place of all or part of the carbon black. When, as is preferred, the compositions are chemically cured, then prior to curing they contain a curing agent, such as a peroxide or a mixture of an amine and a metal oxide, and optionally a co-curing agent such as an ethylenically unsaturated compound, e.g. triallyl isocyanurate.

When it is contacted with the substrate(s) to be encapsulated and/or joined, the composition can be in solid form, e.g. in the form of a tape which is wrapped around or positioned on the substrate, and the composition and the substrate(s) can then be heated to soften the composition and bring it into intimate contact with the substrate(s), preferably under pressure. Alternatively the composition can be heated and applied to the substrate(s) in molten form. In one aspect, the compositions are particularly useful for encapsulating electrical connections, particularly when used in conjunction with a heat-shrinkable polymeric sleeve which is composed of a material, preferably a fluorocarbon polymer, which can be heated so that the sleeve shrinks and the composition is first melted and then cured. For this purpose, of course, the composition should be electrically insulating. The connection can first be covered by an insulating sleeve or it can be directly contacted by the composition. since the composition adheres well to a wide variety of substrates, including in particular metals, fluorocarbon polymers (both in the form of insulating jackets and conductive polymers), and conductive polymers in general, the compositions are useful inter alia for encapsulating a plurality of connections, at least one of the conductors forming at least one of the connections being an electrode of a self-limiting heater which comprises two elongate spaced-apart electrodes, an elongate heating element which comprises a material having a positive temperature coefficient of resistance and through which current passes when the electrodes are connected to a power source, and an insulating jacket which surrounds the electrodes and the heating element.

In another important aspect of the invention, the compositions are used to seal together two metal surfaces, especially in a process in which an elongate electrical device, e.g. a self-limiting heater, is provided with a protective cover by (1) wrapping a metallic foil around the device so that the foil forms a continuous covering over the device with a continuous seam formed by two metal surfaces which are pressed together;

(2) providing between said metal surfaces a layer of a hot, moldable, curable composition which is solid at room temperature and which comprises (a) a polymeric component comprising (i) at least 50% by weight, based on the weight of the polymeric component, of at least one relatively high molecular weight fluorocarbon elastomer having a Mooney viscosity at 121° C. of at least 75, and (ii) 5 to 50% by weight, based on the weight of the polymeric component, of at least one relatively low molecular weight fluorocarbon elastomer having a Brookfield viscosity at 100° C. of 1,000 to 5,000 centipoises;

(b) a curing agent for said polymeric component; and (c) an acid scavenger; and (3) maintaining said layer under conditions which cause it to cure in contact with the metal surfaces while they are pressed together.

In preferred compositions for use in the present invention, the polymeric component comprises 5 to 50% of a fluorocarbon elastomer having a Mooney viscosity at 121° C. of at least 120, 25 to 70% of a fluorocarbon elastomer having a Mooney viscosity at 121° C. of 80 to 110, and 5 to 50% of a fluorocarbon elastomer having a Brookfield viscosity at 100° C. of 1,000 to 4,000 centipoises, the percentages being by weight based on the weight of the polymeric component.

In compositions which are particularly useful for exposure to severe environmental conditions, the polymeric component comprises, and preferably consists essentially of, 15 to 25% of a fluorocarbon elastomer having a Mooney viscosity at 121° C. of 130 to 190, 30 to 75% of a fluorocarbon elastomer having a Mooney viscosity at 121° C. of 80 to 110, and 5 to 30% of a fluorocarbon elastomer having a Brookfield viscosity at 100° C. of 1,000 to 4,000 centipoises, the percentages being by weight based on the weight of the polymeric component. When cured, these compositions show significantly and surprisingly higher resistance to hot oils and aqueous acids, and are therefore especially useful in the manufacture of heaters and other devices which are to be used in oil wells.

In compositions which are particularly useful for encapsulating electrical connections which are not to be subject to such severe environmental conditions, and which have superior moldability, the polymeric component comprises and preferably consists essentially of 20 to 40% of a fluorocarbon elastomer having a Mooney viscosity at 121° C. of 130 to 190, 20 to 40% of a fluorocarbon elastomer having a Mooney viscosity at 121° C. of 80 to 110, and 30 to 50% of a fluorocarbon elastomer having a Brookfield viscosity at 100° C. of 1,000 to 4,000 centipoises, the percentages being by weight based on the weight of the polymeric component.

The invention is illustrated by the following Examples.

EXAMPLES

Compositions containing the ingredients and amounts thereof in parts by weight set out in the Table below were prepared. The ingredients in the Table are further identified below.

Viton AHV is a fluorocarbon elastomer available from du Pont and having a Mooney viscosity at 121° C. of 147 to 173.

Viton GH is a fluorocarbon elastomer available from du Pont and having Mooney viscosity at 121° C. of about 90.

Viton LM is a fluorocarbon elastomer available from du Pont and having a Brookfield viscosity at 100° C. of about 2,000 centipoise.

Thermax 990 is a reinforcing carbon black.

TABLE

| | | | | | | |
|---|---|---|---|---|---|---|
| Viton AHV | 14.8 | — | — | — | 22 | 14.8 |
| Viton GH | 44.4 | 60.8 | 62.0 | 58.2 | 25 | 44.4 |
| Viton LM | 14.8 | 16.5 | 14.8 | 14.5 | 31 | 14.8 |
| Thermax 990 | 2.0 | 2.0 | 2.0 | 2.0 | 10.5 | 14.8 |
| Lead Oxide | 3.0 | 2.0 | — | 2.0 | 3.0 | 3.0 |
| Magnesium Oxide | 2.9 | — | — | — | 3.0 | 2.9 |
| Trisallyl cyanurate | 3.5 | 2.2 | — | 3.5 | 2.0 | 3.5 |
| Peroxide Curing Agent | 1.8 | 3.5 | — | 1.8 | 1.5 | 1.8 |
| Barium Sulfate | 12.8 | 13.0 | 15.9 | 18.0 | — | — |

We claim:

1. A method of protecting an electrical connection which comprises (1) encapsulating the connection with a hot, moldable, curable, electrically insulating composition which is solid at room temperature and which comprises (a) a polymeric component comprising (i) at least 50% by weight, based on the weight of the polymeric component, of at least one relatively high molecular weight fluorocarbon elastomer having a Mooney Viscosity at 121° C. of at least 75, and (ii) 5 to 50% by weight, based on the weight of the polymeric component, of at least one relatively low molecular weight fluorocarbon elastomer having a Brookfield viscosity at 100° C. of 1,000 to 5,000 centipoises;

(b) a curing agent for said polymeric component; and (c) an acid scavenger; and (2) maintaining the composition under conditions which cause it to cure around the connection.

2. A method according to claim 1 wherein the composition is wrapped in solid form around the connection; the wrapped composition is surrounded by a heat-shrinkable polymeric sleeve; and the sleeve and the composition are then heated to cause the sleeve to shrink and the composition to melt; and the heating is continued to cause the composition to cure.

3. A method according to claim 2 wherein the heat-shrinkable sleeve comprises a fluorocarbon polymer.

4. A method according to claim 1 wherein the composition comprises a reinforcing agent.

5. A method according to claim 1 wherein the polymeric component comprises 5 to 50% of a fluorocarbon elastomer having a Mooney viscosity at 121° C. of at least 120, 25 to 70% of a fluorocarbon elastomer having a Mooney viscosity at 121° C. of 80 to 110, and 5 to 50% of a fluorocarbon elastomer having a Brookfield viscosity at 100° C. of 1,000 to 4,000 centipoises, the percentages being by weight based on the weight of the polymeric component.

6. A method according to claim 1 wherein the polymeric component consists essentially of 15 to 25% of a fluorocarbon elastomer having a Mooney viscosity at 121° C. of 130 to 190, 30 to 75% of a fluorocarbon elastomer having a Mooney viscosity at 121° C. of 80 to 110, and 5 to 30% of a fluorocarbon elastomer having a Brookfield viscosity at 100° C. of 1,000 to 4,000 centipoises, the percentages being by weight based on the weight of the polymeric component.

7. A method according to claim 1 wherein the polymeric component consists essentially of 20 to 40% of a fluorocarbon elastomer having a Mooney viscosity at 121° C. of 130 to 190, 20 to 40% of a fluorocarbon elastomer having a Mooney viscosity at 121° C. of 80 to 110, and 30 to 50% of a fluorocarbon elastomer having a Brookfield viscosity at 100° C. of 1,000 to 4,000 centipoises, the percentages being by weight based on the weight of the polymeric component.

8. A method according to claim 1 wherein a plurality of connections are encapsulated together; at least one of the connections is between an electrode of a self limiting heater which comprises two parallel electrodes embedded in a conductive polymer element, the electrode extending from an exposed surface of the conductive polymer element; and the insulating composition also encapsulates the exposed surface of the conductive polymer element.

9. A method according to claim 8 wherein the conductive polymer composition comprises a fluorocarbon polymer.

10. A method according to claim 8 wherein the heater comprises an insulating jacket comprising a fluorocarbon polymer, and the insulating composition also encapsulates one end of the insulating jacket.

11. A method of protecting an elongate electrical device which comprises (1) wrapping a metallic foil around the device so that the foil forms a continuous covering over the device with a continuous seam formed by two metal surfaces which are pressed together;

(2) providing between said metal surfaces a layer of a hot, moldable, curable composition which is solid at room temperature and which comprises (a) a polymeric component comprising (i) at least 50% by weight, based on the weight of the polymeric component, of at least one relatively high molecular weight fluorocarbon elastomer having a Mooney viscosity at 121° C. of at least 75, and (ii) 5 to 50% by weight, based on the weight of the polymeric component, of at least one relatively low moelcular weight fluorocarbon elastomer having a Brookfield viscosity at 100° C. of 1,000 to 5,000 centipoises;

(b) a curing agent for said polymeric component; and (c) an acid scavenger; and (3) maintaining said layer under conditions which cause it to cure in contact with the metal surfaces while they are pressed together.

12. A method according to claim 11 wherein the composition contains a reinforcing agent.

13. A method according to claim 12 wherein the composition contains 8 to 25% by weight of a reinforcing carbon black.

14. A method according to claim 12 wherein the polymeric component comprises 5 to 50% of a fluorocarbon elastomer having a Mooney viscosity at 121° C. of at least 120, 30 to 75% of a fluorocarbon elastomer having a Mooney viscosity at 121° C. of 80 to 110, and 5 to 50% of a fluorocarbon elastomer having a Brookfield viscosity at 100° C. of 1,000 to 4,000 centipoises, the percentages being by weight based on the weight of the polymeric component.

15. A method according to claim 12 wherein the polymeric component consists essentially of 15 to 25% of a fluorocarbon elastomer having a Mooney viscosity at 121° C. of 130 to 190, 30 to 75% of a fluorocarbon elastomer having a Mooney viscosity at 121° C. of 80 to 110, and 5 to 30% of a fluorocarbon elastomer having a Brookfield viscosity at 100° C. of 1,000 to 4,000 centipoises, the percentages being by weight based on the weight of the polymeric component.

16. A method according to claim 11 wherein the metal surfaces are primed before they are contacted by the curable composition.

* * * * *